US005477255A

United States Patent [19]

Huth

[11] Patent Number: 5,477,255

[45] Date of Patent: Dec. 19, 1995

[54] INK CARTRIDGE SYSTEM WITH IMPROVED VOLUMETRIC CAPACITY AND METHOD FOR USING THE SAME

[75] Inventor: Mark Huth, Corvallis, Oreg.

[73] Assignee: Hewlett Packard Corporation, Palo Alto, Calif.

[21] Appl. No.: 118,165

[22] Filed: Sep. 7, 1993

[51] Int. Cl.[6] ..... B41J 2/175

[52] U.S. Cl. ..... 347/87

[58] Field of Search ..... 347/7, 31, 86, 347/87, 93, 94

[56] References Cited

U.S. PATENT DOCUMENTS

| | | | |
|---|---|---|---|
| 2,777,824 | 1/1957 | Leeds . | |
| 3,055,297 | 9/1962 | Leeds . | |
| 3,160,596 | 12/1964 | Spencer . | |
| 3,967,286 | 6/1976 | Andersson | 347/87 |
| 4,007,142 | 2/1977 | Clarke et al. | 521/63 |
| 4,095,237 | 6/1978 | Amberntsson et al. | 347/87 |
| 4,179,027 | 12/1979 | Weisberg | 206/205 |
| 4,192,923 | 3/1980 | Tajkowski | 521/117 |
| 4,306,245 | 12/1981 | Kasugayama et al. | 347/33 |
| 4,307,201 | 12/1981 | Won et al. | 521/64 |
| 4,329,698 | 5/1982 | Smith | 347/87 |
| 4,334,971 | 6/1982 | Mahnke et al. | 347/87 X |
| 4,336,767 | 6/1982 | Wada | 118/264 |
| 4,367,294 | 1/1983 | Hahn et al. . | |
| 4,368,478 | 1/1983 | Koto | 347/86 |
| 4,406,816 | 9/1983 | Sliwka | 521/69 |
| 4,500,895 | 2/1985 | Buck et al. | 347/87 |
| 4,509,062 | 4/1985 | Low et al. | 347/87 |
| 4,511,678 | 4/1985 | Mahnke et al. | 521/52 |
| 4,522,878 | 6/1985 | Martin et al. | 428/313.7 |
| 4,530,940 | 7/1985 | Woerner et al. | 521/124 |
| 4,630,758 | 12/1986 | Mutoh | 347/87 |
| 4,666,948 | 5/1987 | Woerner et al. | 521/105 |
| 4,749,291 | 6/1988 | Kobayashi et al. | 347/87 |
| 4,771,295 | 9/1988 | Baker et al. | 347/87 |
| 4,794,409 | 12/1988 | Cowger et al. | 347/87 |
| 4,929,969 | 5/1990 | Morris | 347/87 |
| 5,079,570 | 1/1992 | Mohr et al. | 347/87 |
| 5,216,450 | 6/1993 | Koitabashi et al. | 347/87 |
| 5,289,212 | 2/1994 | Carlotta | 347/87 |

FOREIGN PATENT DOCUMENTS

| | | |
|---|---|---|
| 14943 | 9/1980 | European Pat. Off. . |
| 46985 | 3/1982 | European Pat. Off. . |
| 322131 | 6/1989 | European Pat. Off. . |
| 2739804 | 11/1978 | Germany . |
| 61-22952 | 1/1986 | Japan . |
| 62-42792 | 9/1987 | Japan . |
| 3-56666 | 8/1991 | Japan . |
| 1495461 | 12/1977 | United Kingdom . |
| 2067470 | 7/1981 | United Kingdom . |

OTHER PUBLICATIONS

Meltzer, Y. L., "Expanded Plastics and Related Products—Developments Since 1978" by Noyes Data Corporation, 1983 (pp. 232–235).

Weber, H., "Neuer elastischer Schaumstoff auf Basis Melaminharz", Kunststoffe, vol. 75, No. 11, pp. 843–848 (1985).

*Hewlett–Packard Journal*, vol. 39, No. 4 (Aug. 1988).

*Primary Examiner*—Benjamin R. Fuller
*Assistant Examiner*—John E. Barlow, Jr.

[57] ABSTRACT

An ink cartridge having an improved ink-retaining capacity. The cartridge (preferably of the thermal inkjet type) includes a housing having a multi-cellular foam member therein. To increase the ink-retaining capacity of the foam member, one or more elongate bores are positioned entirely through the foam member. Each bore is preferably uniform in cross-sectional size and configuration along its entire length, and may encompass numerous cross-sectional configurations (e.g. circular or rectangular). The longitudinal axis of each bore is preferably perpendicular to the longitudinal axis of the foam member. When the foam member is supplied with ink, an additional portion of ink is retained within each bore. As a result, the ink-retaining capacity of the foam member is increased compared with foam members which lack any bores. The bores function as internal ink reservoirs from which ink may be drawn during cartridge operation.

25 Claims, 5 Drawing Sheets

INK CARTRIDGE SYSTEM WITH IMPROVED VOLUMETRIC CAPACITY AND METHOD FOR USING THE SAME

BACKGROUND OF THE INVENTION

The present invention generally relates to ink delivery systems, and more particularly to an ink cartridge for thermal ink jet printers and other printing systems having a substantially improved ink-retaining capacity.

Substantial developments have been made in the field of electronic printing technology. Specifically, a wide variety of highly efficient printing systems currently exist which are capable of dispensing ink in a rapid and accurate manner. Thermal inkjet systems are especially important in this regard. Printing systems using thermal inkjet technology basically involve a cartridge which includes at least one ink reservoir chamber in fluid communication with a substrate having a plurality of resistors thereon. Selective activation of the resistors causes thermal excitation of the ink and expulsion thereof from the ink cartridge. Representative thermal inkjet systems are discussed in U.S. Pat. No. 4,500,895 to Buck et al.; U.S. Pat. No. 4,794,409 to Cowger et al.; U.S. Pat. No. 4,509,062 to Low et al.; U.S. Pat. No. 4,929,969 to Morris; U.S. Pat. No. 4,771,295 to Baker et al., and the *Hewlett-Packard Journal*, Vol. 39, No. 4 (August 1988), all of which are incorporated herein by reference.

In order to retain suitable volumes of ink within a thermal inkjet cartridge (or any other ink cartridge), a multi-cellular absorbent member is typically used which retains ink therein. This ink may then be withdrawn on demand. For example, as stated in U..S. Pat. No. 4,771,295 to Baker et al., a conventional ether-type foam material (e.g. obtainable from the Scott Paper Company of Philadelphia, Pa. (USA)) may be used for this purpose. U.S. Pat. No. 4,794,409 to Cowger et al. discloses a thermal inkjet cartridge having a foam block therein manufactured from reticulated cellulose. Other absorbent materials used in ink Cartridge systems include but are not limited to foam rubber (U.S. Pat. No. 3,967,286 to Anderson et al.), and polyethylene and/or polyurethane foam (U.S. Pat. No. 4,306,245 to Kasugayama et al.)

However, numerous attempts have been made to increase the volumetric ink-retaining capacity of ink cartridges (e.g. thermal inkjet systems). Increased ink-retaining capacity results in improved printing efficiency, reduced printer down-time, and greater consumer economy. For example, U.S. Pat. No. 4,929,969 to Morris discloses a thermal inkjet cartridge which uses an absorbent member constructed from open cell melamine-formaldehyde condensate foam. The patent states that this material imparts improved volumetric capacity to the cartridge. U.S. Pat. No. 4,749,291 to Kobayashi et al. also discloses an ink Cartridge having an absorbent member therein manufactured from melamine-formaldehyde condensate foam.

Notwithstanding the foregoing developments, a need remains for an ink cartridge system having an improved ink-retaining capacity which uses inexpensive, readily—available materials, is easily manufactured, and enables the delivery of ink materials rapidly and effectively. The present invention Satisfies this need in a unique manner as described in detail below.

SUMMARY OF THE INVENTION

It is an object of the present invention to provide an ink cartridge which is characterized by an improved ink-retaining capacity (e.g. improved volumetric capacity).

It is another object of the invention to provide an ink cartridge suitable for use in a thermal inkjet printing system which is characterized by an improved ink-retaining capacity (e.g. improved volumetric capacity).

It is another object of the invention to provide an ink cartridge of improved volumetric capacity which uses a minimal number of operating components, and is manufactured from readily-available, inexpensive materials.

It is a further object of the invention to provide an ink cartridge of improved volumetric capacity which uses a foam-type absorbent member therein which is modified in a unique manner to substantially increase the ink-retaining capacity thereof without increasing the overall size of the absorbent member.

It is an even further object of the invention to provide a method for printing using the foregoing ink cartridge wherein printing may occur for a greater duration before ink depletion occurs.

In accordance with the foregoing objects, the present invention involves an ink cartridge which is modified to retain additional quantities of ink therein compared with unmodified cartridges of the same type and size. While the present invention shall be described hereinafter with respect to thermal inkjet cartridges and printers using the same, the invention shall not be specifically limited to thermal inkjet systems as described in greater detail below.

Basically, in order to produce a thermal inkjet cartridge in accordance with the present invention, a housing comprising a compartment therein is first provided. The housing further includes a first side wall and a second side wall of substantially identical configuration. The first side wall includes a first interior surface and the second side wall includes a second interior surface. Affixed to the housing is a thermal inkjet printhead which consists of a plate member having at least one opening therethrough and multiple resistors mounted on the plate member. Selective activation of the resistors causes thermal excitation of ink retained within the housing and expulsion thereof from the inkjet cartridge as described in the *Hewlett-Packard Journal*, Vol. 39, No. 4 (August 1988), supra.

In order to retain an increased volume of ink within the compartment of the foregoing housing, a specially modified ink-absorbing foam member is positioned therein. The foam member is in fluid communication with the printhead and components associated therewith. As a result, ink may be withdrawn from the foam member on demand. The foam member includes a plurality of ink-retaining cells (e.g. pores) therein, and further includes a first side, a second side, and at least one continuous, elongate tunnel-like bore therethrough from the first side to said second side. The bore is preferably uniform in cross-sectional size and configuration along its entire length. The bore may likewise encompass a wide variety of different cross-sectional configurations. For example, the bore may be circular, square, or rectangular in cross-section.

The first side of the foam member includes a first opening therein and the second side of the foam member includes a second opening therein. The first and second openings both provide unrestricted access to the bore through the foam member. The foam member further includes a longitudinal axis therethrough. This axis passes medially between the first and second sides of the foam member. Likewise, the bore includes a longitudinal center axis passing therethrough. In a preferred embodiment, the bore is positioned within the foam member so that the longitudinal axis of the bore is perpendicular to the longitudinal axis of the foam member.

It is also preferred that the foam member be produced of a compressible, resilient material with a shape substantially corresponding to the shape of the compartment within the housing. In a preferred embodiment, the foam member will be larger (e.g. have greater external dimensions) than the compartment so that placement of the foam member therein causes (1) the first side of the foam member to be urged against the first side wall of the housing; and (2) the second side of the foam member to be urged against the second side wall of the housing. As a result, the first opening in the foam member (which leads into the bore) will be urged against the first interior surface of the first side wall. Likewise, the second opening in the foam member (which also leads into the bore) will be urged against the second interior surface of the second side wall. This arrangement of components prevents liquid ink retained within the bore from leaking outwardly therefrom and passing downwardly along the interior surfaces of the first and second side walls as described in greater detail below.

An alternative embodiment of the invention will involve a thermal inkjet cartridge having all of the foregoing features which further includes multiple bores (e.g. optimally about 2–9 bores) within the foam member. Each of the bores is configured as described above, with access thereto being provided by multiple openings in the first and second sides of the foam member. Each of the bores will likewise have a longitudinal center axis therethrough which is preferably perpendicular to the longitudinal axis of the foam member. Likewise, in a preferred embodiment, the longitudinal axes of the bores will each be parallel to each other within the foam member, with all of the bores being spaced equidistantly from each other therein.

When the foam member within the ink cartridge is filled with liquid ink, a portion of the ink is retained within the multiple cells (e.g. pores) of the foam member. However, a further portion of the ink is retained in bulk quantity within the elongate bore or bores described above. Because of the considerable volumetric capacity of each bore, substantial amounts of ink may be stored therein. As a result, the ink-retaining capacity of the foam member is substantially increased compared with a foam member lacking any bores or comparable cavities. The bores of the present invention therefore function as internal ink reservoirs from which ink may be drawn on demand during use of the printing system. Furthermore, ink will not leak outwardly from any of the bores in an uncontrolled manner. Leakage is prevented due to (1) the dense, reticulated character of the foam material surrounding each bore;and (2) the direct physical engagement between the openings which lead into each bore and the side walls of the housing.

Accordingly, the present invention represents an ink cartridge of simple, efficient design which is characterized by a significantly improved ink-retaining (e.g. volumetric) capacity. This goal is achieved without the use of special foam materials or foam members of enlarged size. The present invention therefore represents a considerable advance in the art of ink printing technology. Accordingly, these and other objects, features, and advantages of the invention will be described below in the following Brief Description of the Drawings and Detailed Description of Preferred Embodiments.

DETAILED DESCRIPTION OF PREFERRED EMBODIMENTS

The present invention involves an ink delivery system which consists of an ink cartridge having a substantially improved ink-retaining capacity. This is specifically accomplished through the use of a specially-designed absorbent foam member characterized by a greater volumetric capacity compared with conventional foam members of comparable size and shape. Improved ink-retaining capacity in an ink cartridge system provides numerous benefits including but not limited to increased operating efficiency, reduced system down-time (due to ink depletion), and increased consumer economy. While the present invention shall be described herein with reference to a thermal inkjet printing system and cartridge unit, the invention may likewise be used in connection with other cartridge-type ink systems which use absorbent foam ink-retaining members. Thus, the present invention shall not be exclusively limited to thermal inkjet systems which are described herein for example purposes.

Figure 1:
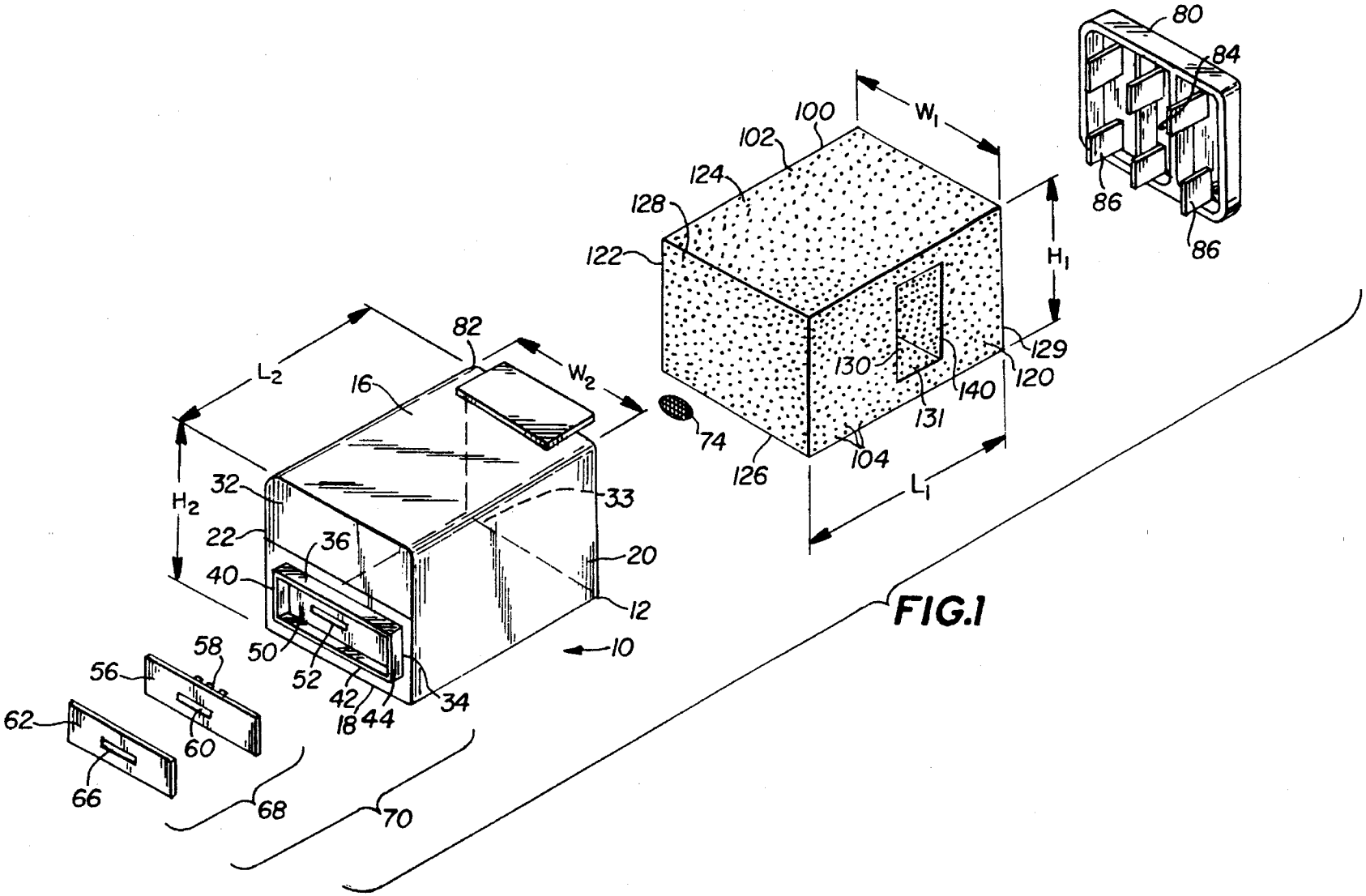
FIG. 1 is an exploded right side perspective view of a representative thermal inkier cartridge which includes a special absorbent foam member produced in accordance with the present invention.
Figure 2:
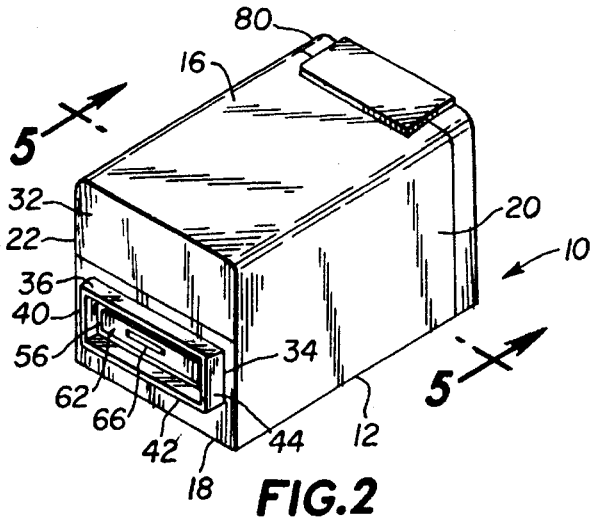
FIG. 2 is an assembled right side perspective view of the ink cartridge of FIG. 1 wherein the foam member is entirely positioned within the cartridge housing.
Figure 5:
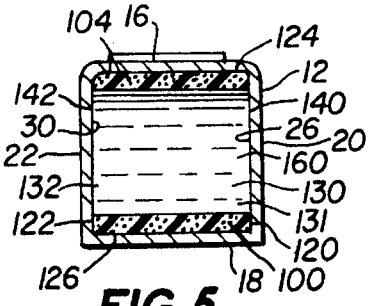
FIG. 5 is a cross-sectional view of the foam member of FIG. 1 taken along line 5—5 of FIG. 2 showing the foam member of FIG. 1 and its orientation within the cartridge housing.

With reference to FIG. 1, an exemplary ink cartridge 10 of the thermal inkjet type is schematically illustrated. This cartridge is of the general type illustrated and described in U.S. Pat. No. 4,794,409 to Cowger et al.; U.S. Pat. No. 4,771,295 to Baker et al.; and the *Hewlett-Packard Journal*, Vol. 39, No. 4 (August 1988), all of which are incorporated herein by reference as noted above. As illustrated in FIGS. 1, 2, and 5, the cartridge 10 consists of a housing 12 preferably of unitary (e.g. single-piece) construction and manufactured from plastic. The housing 12 further includes a top wall 16, a bottom wall 18, a first side wall 20, and a second side wall 22. In the embodiment of FIG. 1, the top wall 16 and the bottom wall 18 are substantially parallel to each other and of the same size. Likewise, the first side wall 20 and the second side wall 22 are substantially parallel to each other and of the same size.

As illustrated in FIG. 5, the first side wall 20 has a planar first interior surface 26 and the second side wall 22 has a planar second interior surface 30. With continued reference to FIG. 1, the housing 12 further includes a front wall 32. Surrounded by the front wall 32, top wall 16, bottom wall 18, first side wall 20, and second side wall 22 is an interior chamber or compartment 33 within the housing 12, the function of which will be described below. The front wall 32 further includes an externally-positioned support structure 34 which is constructed of a plurality of outwardly-extending side sections 36, 40, 42, 44 with a substantially rectangular center zone 50 therebetween. Positioned within the center zone 50 and passing entirely through the front wall 32 of the housing 12 is an elongate ink outlet port 52 which communicates with the compartment 33 inside the housing 12.

Fixedly secured to the front wall 32 of the housing 12 (e.g. preferably using an adhesive composition known in the art) and positioned within the center zone 50 of the support structure 34 is a substrate in the from of a plate member 56 having a plurality of thin film resistors 58 thereon which are schematically illustrated and enlarged for the sake of clarity in FIG. 1. Likewise, the plate member 56 further includes at least one opening 60 therethrough which substantially registers and communicates with the ink outlet port 52 in the assembled cartridge 10 (FIG. 2). In addition, secured to the plate member 56 by adhesive, welding, or the like is an orifice plate 62. The orifice plate 62 is preferably made of an inert metal composition (e.g. gold-plated nickel), and further includes an ink ejection orifice 66 therethrough. The ink ejection orifice 66 is arranged on the orifice plate 62 so that it substantially registers with the opening 60 through the plate member 56 in the assembled cartridge 10 (FIG. 2). For the purposes of this invention, plate member 56, thin film resistors 58, opening 60, orifice plate 62 and ink ejection orifice 66 shall collectively be characterized as "ink expulsion means" 68, the operation of which will be described below. Furthermore, as shown in FIG. 1, the ink expulsion means 68 in combination with the support structure 34 including side sections 36, 40, 42, 44, center zone 50, and ink outlet port 52) shall collectively be characterized as the printhead 70 of the ink cartridge 10 which is fixedly secured to the cartridge 10.

As noted above, the present invention as described herein shall not be limited exclusively to the cartridge 10 shown in FIG. 1 or to thermal inkjet cartridges in general. For example, other cartridges/ink delivery systems may be encompassed within the present invention which involve printhead units having different ink expulsion means other than the thin film resistor assembly set forth above. Alternative ink expulsion means encompassed within the present invention shall include but not be limited to piezoelectric ink drop expulsion systems of the general type disclosed in U.S. Pat. No. 4,329,698 to Smith, dot matrix systems of the type disclosed in U.S. Pat. No. 4,749,291 to Kobayashi et al., as well as other systems which deliver ink from a self-contained reservoir/chamber. Thus, the present invention shall not be exclusively limited to use in connection with thin film thermal inkjet systems as noted above.

With continued reference to FIG. 1, the ink cartridge 10 further includes an ink filter 74 which is mounted within the compartment 33 of the housing 12 as illustrated. Specifically, the ink filter 74 is mounted directly adjacent to and against the ink outlet port 52 in the front wall 32 of the housing 12. The ink filter 74 is preferably manufactured from stainless steel wire mesh having a porosity sufficient to provide substantial filtration of air bubbles and solid particulates when ink passes from the compartment 33 into and through the ink outlet port 52.

As schematically illustrated in FIG. 1, the ink cartridge 10 further includes a cap member 80 which is adapted for affixation (e.g. using a conventional adhesive) to the open rear portion 82 of the housing 12. The cap member 80 also includes at least one air vent 84 which may be covered with a porous plastic membrane (not shown) as discussed in U.S. Pat. No. 4,771,295 to Baker et al. which allows air to pass therethrough while preventing ink leakage from the cartridge 10. Finally, the cap member 80 may further include a plurality of outwardly-extending compression tabs 86, the function of which will be described below. It should be noted that all of the foregoing components in the ink cartridge 10 are conventional in structure and design. Further details regarding such components are again set forth in U.S. Pat. No. 4,794,409 to Cowger et al.; U.S. Pat. No. 4,771,295 to Baker et al.; and the *Hewlett-Packard Journal*, Vol. 39, No. 4 (August 1988).

As described herein, the present invention basically involves the development of an ink cartridge having an increased ink-retaining (e.g. volumetric) capacity. This is accomplished through the use of a specialized ink-retaining absorbent foam member 100 shown in FIGS. 1 and 3–6. The foam member 100 has a body portion 102 which is preferably comprised of a plurality of open pores or cells 104 therein which are schematically illustrated in FIG. 1. The cells 104 are designed to retain ink therein in accordance with known capillary phenomenon. The body portion 102 may be constructed from a wide variety of commercially available multi-cellular materials including but not limited to (1) conventional ether-type polyurethane foam materials (e.g. obtainable from the Scott Paper Company of Philadelphia, Pa. (USA) and described in U.S. Pat. No. 4,771,295 to Baker et al.) which have a porosity of about 60–75 pores per inch; (2) reticulated cellulose as described in U.S. Pat. No. 4,794,409 to Cowger et al.; (3) polyethylene foam as set forth in U.S. Pat. No. 4,306,245 to Kasugayama et al.; and (4) melamine-formaldehyde condensate foam as described in U.S. Pat. Nos. 4,929,969 to Morris and 4,511,678 to Mahnke et al. which is commercially available from BASF Aktiengesellschaft of Germany. Other multi-cellular foam materials which may be used to construct the body portion 102 of the foam member 100 include but are not limited to ether-type polyurethane foam with a porosity of about 75–90 pores/cells per inch which is commercially available from Foamex, Inc. of Eddystone, Pa. (USA). Thus, the present invention shall not be limited to any particular multi-cellular foam material. However, in a preferred embodiment, the foam material used to construct the foam member 100 will optimally have the following physical characteristics: (a) a bulk density of about 19–26 g/m$^3$, with the term "bulk density" being defined as the weight of the foam material per unit volume in grams per cubic meter; (b) approximately 31–37 cells/pores per cm; (c) an average cell size (diameter) of about 180–220 microns; and (d) a void volume of about 88–92%, with the term "void volume" being defined as the amount of open space (e.g. space within the above-described cells) in the selected foam per unit volume thereof. However, it should again be noted that the foam material ultimately selected for use in the present invention shall not be exclusively limited to compositions having the foregoing structural parameters.

The ultimate size (e.g. length, width, height, etc.) of the body portion 102 of the foam member 100 may be varied, depending on the size and configuration of the ink cartridge 10 in which it is positioned. Likewise, the basic shape of the foam member 100 may be varied, and shall not be limited to a cube or rectangular polygon as shown in FIG. 1. However, it is preferred that the overall size of the foam member 100 exceed the size of the compartment 33 in the housing 12 of the ink cartridge 10 so that the foam member 100 is compressed when inserted within the compartment 33. In a preferred embodiment as illustrated in FIG. 1, the length "$L_1$" of the body portion 102 of the foam member 100 will exceed the length "$L_2$" of the compartment 33, the width "$W_1$" of the body portion 102 will exceed the width "$W_2$" of the compartment 33, and the height "$H_1$" of the body portion 102 will exceed the height "$H_2$" Of the compartment 33. Optimally, "$L_1$" will exceed "$L_2$" by about 5–10%, "$W_1$" will exceed "$W_2$" by about 5–20%, and "$H_1$" will exceed "$H_2$" by about 5–20%. However, the present invention shall not be limited exclusively to these specific numerical values. In addition, for the purposes of this invention, the body portion 102 of the foam member 100 shall be considered larger in size than the compartment 33 in the housing 12 when at least "$W_1$">"$W_2$" , and preferably when all of the dimensions of the body portion 102 exceed the corresponding dimensions of the compartment 33.

With continued reference to FIGS. 1 and 3–6, the body portion 102 of the foam member 100 further includes a first side 120, a second side 122, a top portion 124, a bottom portion 126, a front portion 128, and a rear portion 129. As illustrated in FIGS. 1 and 3–6, the first side 120 and the second side 122 are substantially planar as described in greater detail below. Passing continuously through the body portion 102 from the first side 120 to the second side 122 thereof is an elongate, tunnel-like bore 130 having a first end 131 and a second end 132. In a preferred embodiment, the bore 130 will be rectangular in cross-section with a uniform cross-sectional size/configuration from the first end 131 to the second end 132 thereof (e.g. from the first side 120 of the foam member 100 to the second side 122 thereof). The length and overall internal volume of the bore 130 will be variable, depending on the size of the foam member 100 in which it is positioned and other extrinsic factors. However, in a preferred embodiment, the internal volume of the bore 130 will constitute about 25–40% of the entire volume of the body portion 102 of the foam member 100, although the present invention shall not be limited to this numerical range. For any selected value within the above percentage range, the dimensions of the bore 130 (which, in the present, embodiment, is rectangular in cross-section) may be calculated as follows:

$$V_{bore}=(V_{foam\ member})\times P \quad (1)$$

[wherein: P=the desired volume percentage within the above range; and $V_{foam\ member}=(L_1\times H_1\times W_1)$ since the foam member 100 is a rectangular polygon.]

Once $V_{bore}$ is obtained, the width "$W_3$" and height "$H_3$" (FIG. 4) of the bore 130 may then be calculated using the following equation:

$$V_{bore}=(W_3)\times(H_3)\times(\text{length of the bore}) \quad (2)$$

It should be noted that the length of the bore 130 equals the width "$W_1$" of foam member 100 because the bore 130 extends entirely through the body portion 102 from the first side 120 to the second side 122 thereof. Because $V_{bore}$ and the length of the bore are known values, the only variables in equation (2) are "$W_3$" and "$H_3$". Thus, by selecting a numerical value for "$W_3$", "$H_3$" can be calculated. Likewise, by selecting a numerical value for "$H_3$", "$W_3$" can be calculated.

Figure 7:
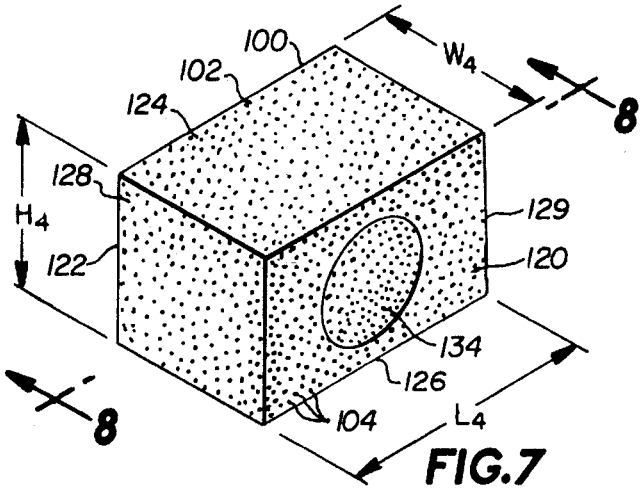
FIG. 7 is a right side perspective view of an alternative absorbent foam member produced in accordance with the invention, wherein the cross-sectional configuration of the bore therethrough has been modified.
Figure 8:
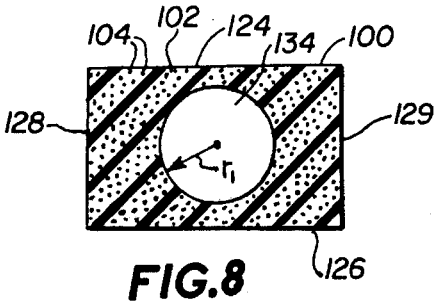
FIG. 8 is a cross-sectional view of the alternative foam member of FIG. 7 taken along line 8—8 of FIG. 7.

It should again be noted that the present invention shall not be limited with respect to the use of a bore 130 of any particular size. Also, the invention shall not be limited to a bore 130 having any particular cross-sectional configuration. For example, as shown in FIGS. 7–8, a bore 134 is provided within the foam member 100 which is uniformly circular in cross-section and uniform in size along its entire length. Likewise, the bores of the present invention may be uniformly square in cross-section (not shown). It is again preferred that the circular bore 134 have an internal volume equal to about 25–40% of the entire volume of the foam member 100 as noted above.

With continued reference to FIGS. 7–8, to determine the proper dimensions used in producing a circular bore 134 (e.g. the radius "$r_1$" as shown in FIG. 8), a mathematical approach is used which is comparable to the approach used above regarding rectangular bore 130. Specifically, if the foam member 100 again consists of a rectangular polygon as illustrated in FIG. 7, the preferred internal volume of bore 134 with a uniform, circular cross-section may be calculated as follows:

$$V_{bore}=(V_{foam\ member})\times P \quad (3)$$

[wherein: P=the desired volume percentage within the above range; and $V_{foam\ member}=(L_4\times H_4\times W_4)$ as shown in FIG. 7 since the foam member 100 is a rectangular polygon.]

Once $V_{bore}$ is obtained, the radius "$r_1$" (FIG. 8) of the bore 134 may then be calculated using the following equation:

$$V_{bore}=(\pi)\times(r_1)^2\times(\text{length of the bore}) \quad (4)$$

It should be noted that the length of the circular bore 134 again equals the width "$W_4$" of foam member 100 shown in FIG. 7 because the bore 134 extends entirely through the body portion 102 from the first side 120 to the second side 122 thereof. Because $V_{bore}$, the length of the bore, and ($\pi$) are known values, the only variable in equation (4) is "$(r_1)^2$". Accordingly, "$(r_1)^2$" may be calculated as follows:

$$(r_1)^2=\frac{V_{bore}}{(\pi)\times(\text{length of the bore})} \quad (5)$$

By taking the square root of "$(r_1)^2$", the radius "$r_1$" of the bore 134 may be determined. Likewise, as previously noted, the formation of other bores having different cross-sectional configurations may be calculated in a comparable manner using the mathematical relationships set forth above. It should be noted that, while the remaining information presented herein shall be discussed with reference to bore 130

(unless otherwise indicated), such information shall be equally applicable to bore 134 and other bores of differing cross-sectional configuration.

The above-described bores 130, 134 (and other bores encompassed within the present invention) may be produced in a variety of ways using a number of commercially available cutting instruments designed to remove a desired quantity of foam from the body portion 102. An exemplary method for producing the bores of the present invention will involve conventional die cutting of the selected foam from sheet stock using either a punch and die set or a steel rule die set, both of which are commercially available tool systems.

Figure 3:
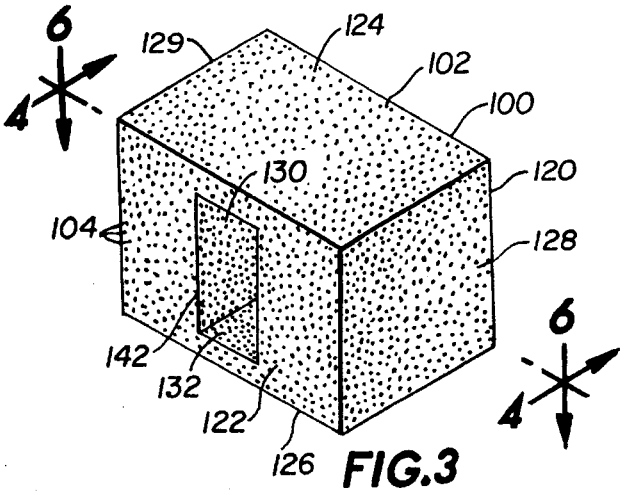
FIG. 3 is a left side perspective view of the foam member of FIG. 1.
Figure 4:
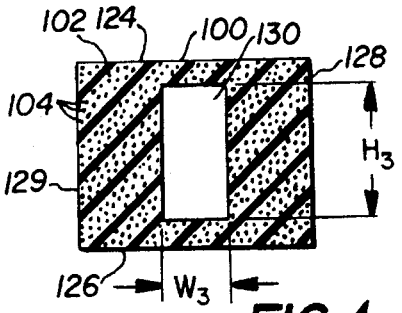
FIG. 4 is a cross-sectional view of the foam member of FIG. 3 taken along line 4—4 of FIG. 3.

Referring back to FIGS. 1 and 3, the first side 120 of the foam member 100 includes a first opening 140 therein which provides unrestricted access to the first end 131 of the bore 130 (FIG. 1). In a preferred embodiment, the first opening 140 will have a cross-sectional configuration (e.g. size and shape) substantially identical to the selected cross-sectional configuration of the bore 130 associated therewith. Likewise, the second side 122 of the foam member 100 will include a second opening 142 therein which provides unrestricted access to the second end 132 of the bore 130 (FIG. 3). It is again preferred that the second opening 142 have a cross-sectional configuration (e.g. size and shape) substantially identical to the cross-sectional configuration of the bore 130 associated therewith.

Figure 6:
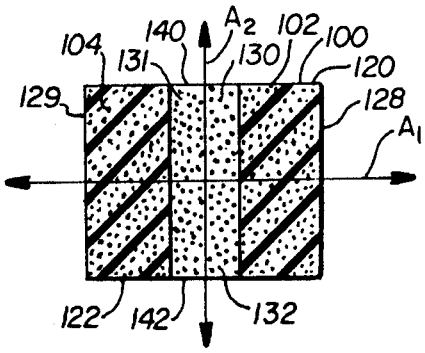
FIG. 6 is a cross-sectional view of the foam member of FIG. 3 taken along line 6—6 of FIG. 3.

As illustrated in FIG. 6, the body portion 102 of the foam member 100 will have a longitudinal center axis "$A_1$" extending medially between the first side 120 and the second side 122 thereof. Likewise, the bore 130 will have a longitudinal center axis "$A_2$" extending therethrough from the first end 131 to the second end 132 as illustrated in FIG. 6. In a preferred and optimal embodiment, the axis "$A_1$" of the foam member 100 is perpendicular to the axis "$A_2$" of the bore 130 as illustrated. The benefits associated with this configurational arrangement will be described in greater detail below. It should further be noted that the bore 130 may be located at any desired position between the front portion 128 and the rear portion 129 of the foam member 100 as long as the bore 130 is not placed at a location where it will be punctured by any devices or structures used to fill the foam member 100 with ink. The bore 130 may likewise be located at any desired position between the top portion 124 and bottom portion 126 of the foam member 100. Accordingly, the ultimate position of the bore 130 within the body portion 102 of the foam member 100 may be varied during production, provided that (1) the foregoing preferred axial arrangement between "$A_1$" and "$A_2$" is maintained; and (2) the bore 130 will not be punctured during the filling of foam member 100 with ink.

As indicated above, all of the external dimensions (length, width, height, etc.) of the body portion 102 of foam member 100 preferably exceed those of the compartment 33 in the housing 12. As a result, the foam member 100 is substantially compressed when positioned within the compartment 33. Specifically, the top portion 124 and the bottom portion 126 of the foam member 100 are compressed against the top wall 16 and the bottom wall 18, respectively, of the housing 12. The front portion 128 of the foam member 100 is likewise positioned against the front wall 32 of the housing 12 so that the front portion 128 is in direct contact and/or fluid communication with the ink filter 74, ink outlet port 52, and the other components of the ink expulsion means 68 as defined above. Finally, the first side 120 (and opening 140 therein) of the foam member 100 is firmly urged against the first interior surface 26 of the first side wall 20 of the housing 12 (FIG. 5). In a similar manner, the second side 122 (and opening 142 therein) of the foam member 100 is firmly urged against the second interior surface 30 of the second side wall 22 of the housing 12 (FIG. 5). As a result, the bore 130 is effectively positioned between the first and second side walls 20, 22 of the housing 12, thereby preventing any liquid materials (e.g. ink) retained within the bore 130 from prematurely leaking outwardly in an uncontrolled manner from the first and second ends 131, 132 thereof as will be described in greater detail below.

After placement of the body portion 102 of the foam member 100 within the compartment 33 (and after filling the foam member 100 with ink as described below), the cap member 80 is secured to the open rear portion 82 of the housing 12 using a conventional adhesive composition. Upon attachment of the cap member 80 to the open rear portion 82 of the housing 12, the above-described compression tabs 86 illustrated in FIG. 1 will be urged against the rear portion 129 of the foam member 100 in order to maintain the foam member 100 in a proper compressed orientation within the compartment 33. With this step, construction of the ink cartridge 10 is substantially completed.

The bore 130 within the body portion 102 of the foam member 100 serves an important and beneficial function in the present invention. Basically, when the foam member 100 is filled with ink (using a standard needle-type filling apparatus or the like), ink is retained within the multiple pores or cells 104 in a conventional manner. However, the bore 130 serves as an extra reservoir within the foam member 100 for holding more ink than the foam member 100 could possibly retain in the absence of bore 130. With reference to FIG. 5, the bore 130 is illustrated showing a supply 160 of liquid ink therein which may involve any type of commercially-available ink known in the art for inkjet printing. Depending on the size of the bore 130 relative to the size of the entire foam member 100, the use of a single bore 130 can increase the ink-retaining capacity of the foam member 100 by about 10–25% compared with a conventional foam member of identical size and construction material which lacks the bore 130. Not only does this result in increased printing efficiency and the reduction of system down-time, but it also improves consumer economy since ink cartridges having one or more bores therein will last longer before ink depletion occurs.

With the supply 160 of ink in the bore 130, such ink may be withdrawn by capillary action through the open cells 104 of the foam member 100 during use of the ink cartridge 10. However, the supply 160 of ink will remain within the bore 130 until needed, and will not leak prematurely therefrom for numerous reasons including but not limited to: (1) the perpendicular, non-tilted orientation of the bore 130 relative to the longitudinal axis "$A_1$" of the foam member 100 as described above; (2) the firm, abutting engagement of the first side 120 of the foam member 100 (and opening 140 therein) with the first side wall 20 of the housing 12; (3) the firm, abutting engagement of the second side 122 of the foam member 100 (and opening 142 therein) with the second side wall 22 of the housing 12; and (4) the dense, reticulated character of the foam material surrounding the bore 130. Thus, use of the bore 130 represents a simple, efficient, and effective method for increasing the volumetric capacity of the foam member 100 and ink cartridge 10 without the use of added structural components, special foam materials, or increased cartridge/foam member size.

It should be noted that the present invention as described herein shall not be limited to a cartridge having a single foam member therein. The invention shall also be applicable with respect to a multi-chamber cartridge of the type disclosed in U.S. Pat. No. 4,771,295 to Baker et al. which includes a plurality of foam members therein. Each of these foam members may be configured in a comparable manner to foam member 100, and may include at least one bore 130 having the characteristics set forth above.

Figure 9:
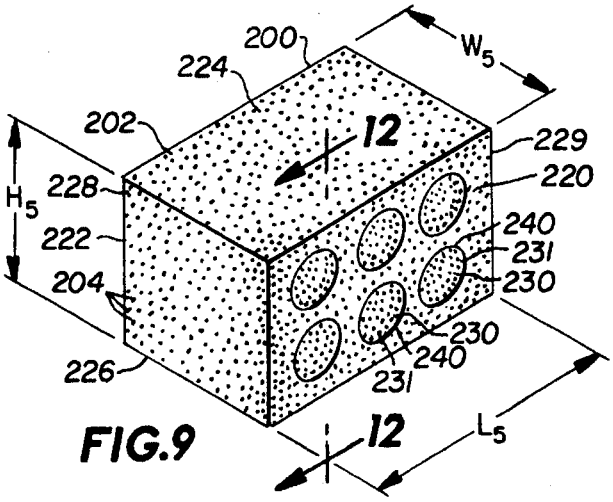
FIG. 9 is a right side perspective view of a further alternative absorbent foam member produced in accordance with the invention which includes a plurality of bores therethrough.
Figure 10:
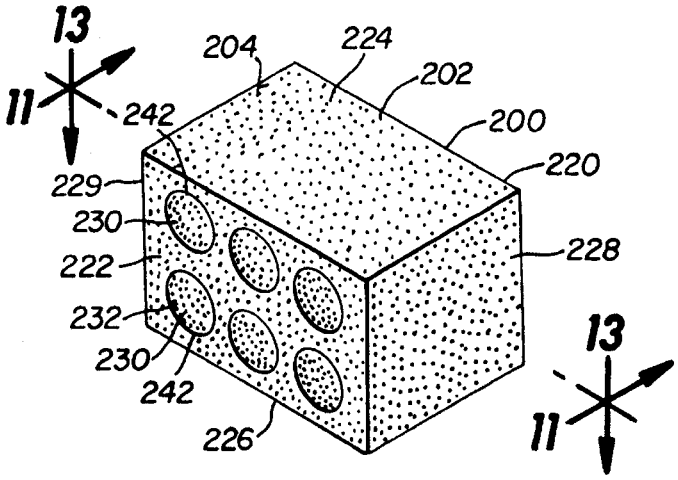
FIG. 10 is a left side perspective view of the further alternative foam member of FIG. 9.
Figure 11:
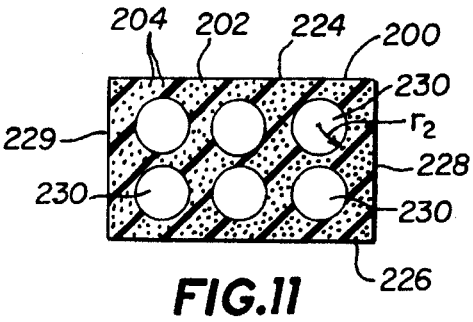
FIG. 11 is a cross-sectional view of the further alternative foam member of FIG. 9 taken along line 11—11 of FIG. 10.
Figure 12:
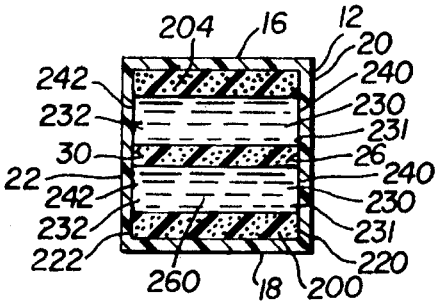
FIG. 12 is a cross-sectional view taken along line 12—12 of FIG. 9 showing the further alternative foam member of FIG. 9 within the housing of the ink cartridge of FIG. 1.

In addition, a further alternative embodiment of the foam member 100 shown in FIGS. 1 and 3–6 is illustrated in FIGS. 9–13. Specifically, a foam member 200 is provided which is identical to foam member 100 in structure, function, size, shape, and construction material. Like foam member 100, foam member 200 includes a body portion 202, a first side 220, a second side 222, a top portion 224, a bottom portion 226, a front portion 228, and a rear portion 229. As illustrated in FIGS. 9–10, the first side 220 and the second side 222 are substantially planar as described in greater detail below. However, instead of having bore 130 therein, the body portion 202 of the foam member 200 instead includes a plurality of circular bores 230 therein which, in a preferred embodiment, are equal to each other in cross-sectional size/configuration, and uniformly spaced from each other as shown in FIG. 9. The bores 230 may vary in size and cross-sectional configuration as desired and described below. Each of the bores 230 may be formed within the foam member 200 using the same techniques set forth above with respect to the single bore 130. The number of bores 230 may be varied as desired, primarily depending on the overall size of the foam member 200. Each bore 230 includes a first end 231 and a second end 232 as illustrated in FIGS. 9–10. Once again, each of the bores 230 is preferably uniform in cross-sectional size/configuration from the first end 231 to the second end 232 thereof.

Figure 14:
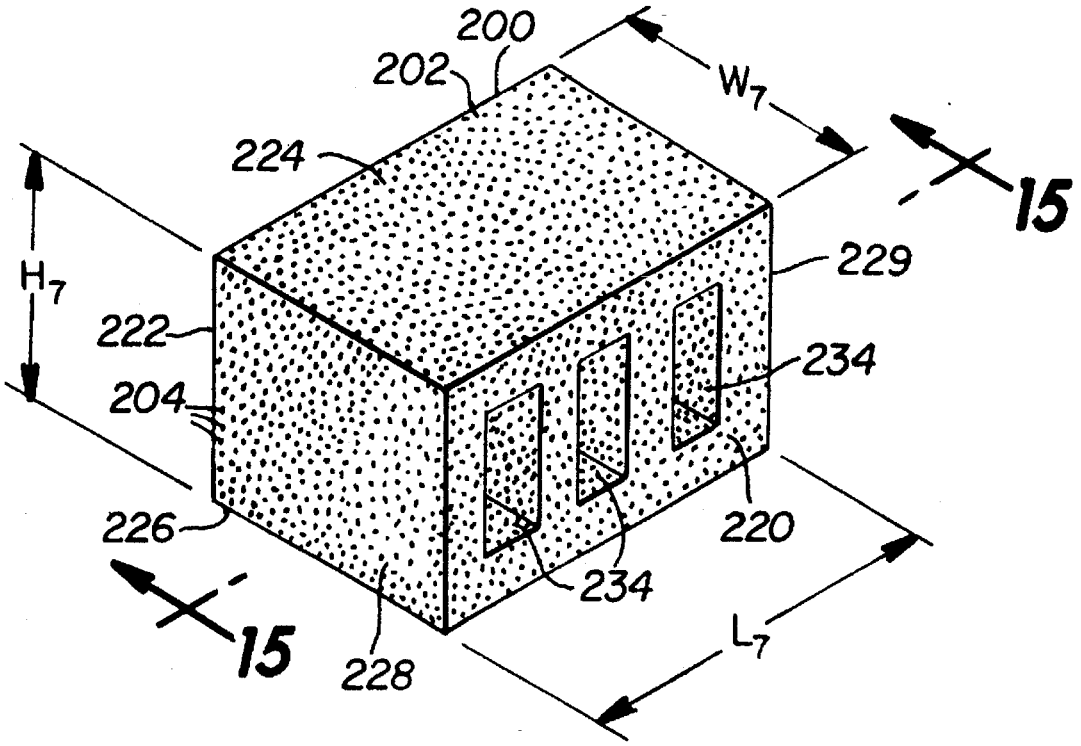
FIG. 14 is a right side perspective view of a still further alternative absorbent foam member produced in accordance with the invention, wherein the foam member includes a plurality of bores therethrough in which the cross-sectional configuration of each bore has been modified compared with the embodiment of FIG. 9.
Figure 15:
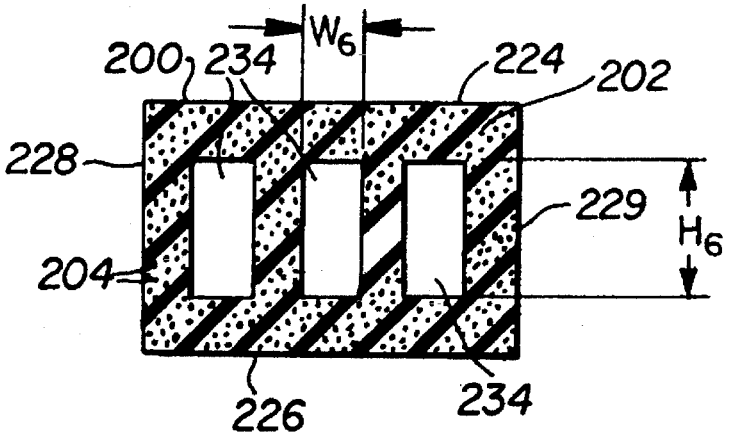
FIG. 15 is a cross-sectional view of the still further alternative foam member of FIG. 14 taken along line 15—15 of FIG. 14.

Each of the circular bores 230 illustrated in FIGS. 9–13 has a size (e.g. radius) and volume which is approximately 25–30% of the corresponding size and volume of the circular bore 134 shown in FIGS. 7–8. However, the bores 230 may each have a different cross-sectional configuration, and shall not be limited to the configuration shown in FIGS. 9–13. For example, the bores 230 may be uniformly rectangular (FIGS. 14–15) or square in cross-section (not shown). With reference to FIGS. 14–15, a plurality of bores 234 are provided within the foam member 200 which are each uniformly rectangular in cross-section along the entire length thereof. It should also be noted that, while the remaining information presented herein involving the use of a foam member 200 having multiple bores shall be discussed with reference to circular bores 230, such information shall be equally applicable to rectangular bores 234 and other bores of differing cross-sectional configuration. It should likewise be noted that all of the bores in a multi-bore foam member do not necessarily have to be of identical size and cross-sectional configuration. It is contemplated and within the scope of the present invention that a foam member could be produced having multiple bores therein in which some of the bores have one cross-sectional configuration (e.g. circular) while other bores have a different cross-sectional configuration (e.g. rectangular).

Referring back to FIGS. 9–10, the first side 220 of the foam member 200 includes a plurality of first openings 240 therein, with each opening 240 providing unrestricted access to the first end 231 of one of the bores 230 (FIG. 9). In a preferred embodiment, each of the first openings 240 will have a cross-sectional configuration (e.g. size and shape) substantially identical to the cross-sectional configuration of the particular bore 230 associated therewith. Likewise, the second side 222 of the foam member 200 will include a plurality of second openings 242 therein, with each opening 242 providing unrestricted access to the second end 232 of one of the bores 230 (FIG. 10). It is likewise preferred that each second opening 242 have a cross-sectional configuration (e.g. size and shape) substantially identical to the cross-sectional configuration of the particular bore 230 associated therewith.

Figure 13:
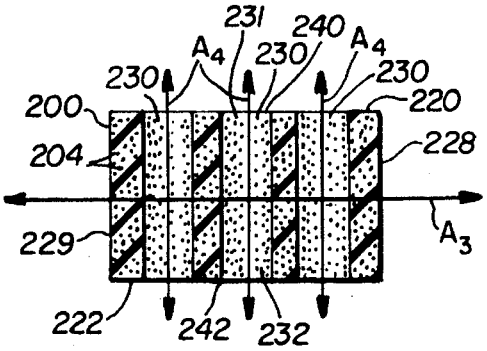
FIG. 13 is a cross-sectional view of the further alternative foam member of FIG. 9 taken along line 13—13 of FIG. 10.

As illustrated in FIG. 13, the body portion 202 of the foam member 200 will have a longitudinal center axis "$A_3$" extending medially between the first side 220 and the second side 222 thereof. Likewise, each of the bores 230 will have a longitudinal center axis "$A_4$" extending therethrough from the first end 231 to the second end 232. In a preferred and optimal embodiment, all of the axes "$A_4$" with respect to each of the bores 230 are parallel to each other as shown in FIG. 13. Furthermore, the axis "$A_3$" of the foam member 200 is perpendicular to all of the axes "$A_4$" of the bores 230 (FIG. 13). The benefits associated with this configurational arrangement will involve the prevention of uncontrolled ink leakage from the bores 230 in the same manner described above relative to single bore 130 (or the other single bore structures set forth herein). It should also be noted that the bores 230 may be located at any desired position between the front portion 228 and the rear portion 229 of the foam member 200 as long as none of the bores 230 are positioned at a location where they will be punctured by the devices or structures used to fill the foam member 200 with ink. The bores 230 may also be located at any desired position between the top portion 224 and the bottom portion 226 of the foam member 200. Accordingly, the ultimate position of the bores 230 within the body portion 202 of the foam member 200 may be varied during production, provided that (1) the foregoing axial arrangement between axis "$A_3$" and axes "$A_4$" is maintained; and (2) none of the bores 230 will be punctured during the filling of foam member 200 with ink.

Again, as noted above, the number of bores 230 (or bores 234) used in the foam member 200 may be varied. However, in a preferred embodiment, the total, combined internal volume of the multiple bores (regardless of cross-sectional configuration) will represent about 25–40% of the entire volume of the foam member 200. Using a selected value within this range, and knowing the number of multiple bores which are desired (assuming that such bores are to be uniform in size), the size (e.g. radius) of each circular bore can be readily calculated. For example, if the foam member 200 consists of a cube or rectangular polygon as illustrated in FIG. 9, the radius "$r_2$" (FIG. 11) of each circular bore 230 can be determined. To accomplish this, the internal volume of each bore 230 is first calculated by the following formula:

$$V_{bore} = \frac{(V_{foam\ member}) \times P}{(N)} \tag{6}$$

[wherein: P=the desired volume percentage within the above range; $V_{foam\ member}=(L_5 \times H_5 \times W_5)$ as shown in FIG. 9 since the foam member 200 is a rectangular polygon; and N=the desired number of bores.]

Once $V_{bore}$ is obtained, the radius of each bore 230 may then be calculated using the following equation:

$$V_{bore}=(\pi)\times(r_2)^2\times(\text{length of each bore}) \tag{7}$$

It should be noted that the length of each circular bore again equals the width "$W_5$" of foam member 200 shown in FIG. 9 because each bore 230 extends entirely through the body portion 202 from the first side 220 to the second side 222 thereof. Because $V_{bore}$, the length of each bore 230, and ($\pi$) are known values, the only variable in equation (7) is "$(r_2)^2$". Accordingly, "$(r_2)^2$" may be calculated as follows:

$$(r_2)^2 = \frac{V_{bore}}{(\pi) \times (\text{length of each bore})} \quad (8)$$

By taking the square root of "$(r_2)^2$", the radius "$r_2$" of each bore 230 may be determined.

Likewise, as previously noted, the formation of other bores having different cross-sectional configurations may be calculated in a comparable manner using the mathematical relationships set forth above. For example, if the foam member 200 again consists of a cube or rectangular polygon as illustrated in FIG. 14, the width "$W_6$" and height "$H_6$" of each rectangular bore 234 shown in FIG. 15 can be determined. To accomplish this, the internal volume of each bore 234 is first calculated by the following formula:

$$V_{bore} = \frac{(V_{foam\ member}) \times P}{(N)} \quad (9)$$

[wherein: P=the desired volume percentage within the above range; $V_{foam\ member}=(L_7 \times H_7 \times W_7)$ as shown in FIG. 14 since the foam member 200 is a rectangular polygon; and N=the desired number of bores.]

Once $V_{bore}$ is obtained, the width "$W_6$" and height "$H_6$" (FIG. 15) of each bore 234 may then be calculated using the following equation:

$$V_{bore}=(W_6)\times(H_6)\times(\text{length of each bore}) \quad (10)$$

It should again be noted that the length of each bore 234 equals the width "$W_7$" of the foam member 200 in FIG. 14 because each bore 234 extends entirely through the body portion 202 from the first side 220 to the second side 222 thereof. Because $V_{bore}$ and the length of the bore are known values, the only variables in equation (10) are "$W_6$" and "$H_6$". Thus, by selecting a numerical value for "$W_6$", "$H_6$" can be calculated. Likewise, by selecting a numerical value for "$H_6$", "$W_6$" can be calculated.

The use of multiple bores (e.g. bores 230 or 234) compared with, e.g., a single bore 130 (or bore 134) may be undertaken for a variety of reasons. For example, in certain instances, the use of multiple bores will result in a more structurally uniform foam member which enables more uniform compression of the foam member within the selected cartridge housing. However, the multiple bores will individually and collectively function in the same general manner set forth above relative to a single bore, and will generally provide comparable benefits. Thus, all of the general features, functional capabilities, and operational characteristics of single bore systems are equally applicable to multiple bore systems and vice versa.

Referring back to FIGS. 9–13, FIG. 12 specifically illustrates individual supplies 260 of ink retained within each of the bores 230. The supplies 260 of ink retained within each bore 230 may be withdrawn by capillary action through the open pores or cells 104 of the surrounding foam in the foam member 200 during use of the ink cartridge 10. However, the supplies 260 of ink will remain within the bores 230 until needed, and will not leak prematurely therefrom for numerous reasons including but not limited to: (1) the perpendicular, non-tilted orientation of the bores 230 relative to the longitudinal axis "$A_3$" of the foam member 200; (2) the firm, abutting engagement of the first side 220 of the foam member 200 (and openings 240 therein) with the first side wall 20 of the housing 12; (3) the firm, abutting engagement of the second side 222 of the foam member 200 (and openings 242 therein) with the second side wall 22 of the housing 12; and (4) the dense, reticulated character of the foam material surrounding the bores 230. Thus, the use of bores 230 (and other multiple bores of differing configuration) represents a simple, efficient, and effective method for further increasing the volumetric capacity of the foam member 200 and ink cartridge 10 without the use of added structural components, special foam materials, or increased cartridge size.

OPERATION

Operation of the present invention will now be described with reference to ink cartridge 10 as illustrated in FIGS. 1–2 having foam member 100 (and bore 130) therein. However, the details, steps, and procedures presented herein shall be equally applicable to systems incorporating a single bore of differing configuration (e.g. bore 134) or systems involving multiple bores (e.g. bores 230 or 234). Thus, the operational techniques set forth below shall not limit the present invention in any manner.

The cartridge 10 of a general type comparable to that shown in FIGS. 1, 2, and 5 is first positioned within a conventional printing apparatus (not shown) known in the art and suitable for thermal inkjet printing. An exemplary printing apparatus would include a product sold under the trademark DESKJET by the Hewlett-Packard Company of Palo Alto, Calif. (USA). It should be noted that the cartridge 10 was previously supplied with ink in an amount sufficient to entirely saturate the foam member 100 so that the cells 104 retain ink therein. Also, the cartridge 10 was supplied with a sufficient amount of ink so that the bore 130 in the foam member 100 includes its own supply 160 of ink therein as shown in FIG. 5. As indicated above, the foam member 100 is supplied with ink in a conventional manner which traditionally involves the placement of a hollow, needle-like apparatus (not shown) into the body portion 102 of the foam member 100, followed by the injection of ink therein. The techniques used to the fill the foam member 100 are substantially identical to the techniques used to fill conventional foam members which lack bore 130, except that additional care is taken to avoid penetration of the bore 130 with the filling apparatus.

Next, the ink expulsion means 68 is activated by the printing apparatus in order to deliver ink from the foam member 100 to a selected substrate (e.g. paper). This is specifically accomplished by selectively energizing the thin film resistors 58 on the plate member 56 (FIG. 1). As a result, ink positioned at the opening 60 in the plate member 56 is thermally excited and expelled outwardly through the ink ejection orifice 66 in the orifice plate 62 onto the paper or other selected substrate. In this manner, the cartridge may be used to print images on the selected substrate. Further information regarding the thermal inkjet printing process is again set forth in the *Hewlett-Packard Journal*, Vol. 39, No. 4 (August 1988).

As ink is expelled in accordance with the foregoing procedures, it is continuously being withdrawn from the cells 104 in the foe member 100 by capillary action. Furthermore, as ink is withdrawn from the cells 104, a fluid pressure gradient is created wherein ink is consequently withdrawn from the supply 160 in the bore 130. Due to the substantial size of the supply 160, the cartridge 10 will be able to print for a greater duration before running out of ink compared with cartridges using foam members of identical size and construction material which lack bore 130 (or any bores).

As noted above, the bore 130 is capable of retaining a significant supply of ink therein. In the absence of bore 130, the space occupied thereby would be "filled" with reticulated, multi-cellular foam materials. While such materials are capable of retaining ink therein, this amount of ink would be less than the amount of ink stored in bore 130 due to the highly reticulated, fibrous structure of the foam materials being used. Thus, the use of foam members with one or more bores therein significantly enhances the ink retaining characteristics thereof, with the increase in volumetric capacity depending the size and number of bores being used.

EXAMPLE

The following Example demonstrates the benefits achieved in accordance with a preferred embodiment of the present invention. A foam member (foam member 1) manufactured from ether-type polyurethane foam which is commercially available from Foamex, Inc. of Eddystone, Pa. (USA) was initially selected. Foam member 1 was calculated to have a volume of about 47 $cm^3$.

A second foam member (foam member 2) was then selected which had the same physical characteristics as foam member 1 (e.g. the same volume, size, and construction material). However, foam member 2 included nine bores therein, with each bore being uniformly circular in cross-section and having a radius of about 0.635 cm. The circular bores were equally spaced from each other, and each bore had an internal volume of about 1.16 $cm^3$, with a total volume for all of the combined bores of about 10.44 $cm^3$.

A third foam member (foam member 3) was also selected which had the same physical characteristics as foam member 1 (e.g. the same volume, size, and construction material). Foam member 3 had a single rectangular bore therein having a height of about 3.8 cm, a length of about 1.0 cm, and a width of about 2.0 cm, with an internal volume of about 7.6 $cm^3$.

Foam members 1–3 were then positioned within a conventional thermal inkjet cartridge of the type illustrated in FIGS. 1–2, and supplied with ink so that the foam members 1–3 were entirely saturated with the same type of ink. The compartment within the housing of each ink cartridge had an internal volume of 36 $cm^3$. The cartridges containing foam members 1–3 (designated as cartridges 1–3, respectively) were then activated in order to expel ink therefrom. The following results were received as summarized in Table I:

TABLE I

| | Cartridge 1 | Cartridge 2 | Cartridge 3 |
|---|---|---|---|
| Cartridge dry wt. (g) ("A") | 42.8 | 36.3 | 37.16 |
| Cartridge wt. after saturation with ink (g) ("B") | 73.4 | 68.8 | 70.36 |
| Wt. of ink retained within foam member (g) ("B" – "A") | 30.6 | 32.5 | 33.2 |
| Wt. percentage of "B" which involves ink [("B" – "A")/("B")] | 42% | 47% | 47% |
| Cartridge wt. after cessation of printing* (g) ("C") | 51.4 | 43.8 | 46.06 |
| Amount of ink actually delivered (g) ("B" – "C") | 22.0 | 25.0 | 24.3 |
| Printing efficiency [("B" – "C")/("B" – "A")] | 72% | 77% | 73% |
| Volumetric efficiency [("B" – "C")/36 $cm^3$] | 61% | 69% | 68% |

*the weight of the cartridge when no further ink could be expelled from the cartridge.

As indicated above, superior ink-retaining/dispensing results were achieved by the cartridges which included foam members having one or more bores therein (e.g. cartridges 2 and 3) compared with cartridge 1 which used a foam member that did not include any bores. Specifically, cartridges 2 and 3 were able to retain significantly more ink therein (32.5 g and 33.2 g, respectively) compared with cartridge 1 which retained 30.6 g of ink. As a result, 47% of the total, filled weight of cartridges 2 and 3 consisted of ink, compared with a value of 42% for cartridge 1. This difference in ink-retaining capacity is significant.

In addition, cartridges 2 and 3 were able to deliver a greater amount of ink (25.0 g and 24.3 g, respectively) compared with cartridge 1 (22.0 g). Cartridges 2 and 3 therefore had a greater printing efficiency, and were able to deliver a somewhat larger amount of the initial ink supply retained therein (77% and 73%, respectively) compared with cartridge 1 which delivered 72% of its initial ink supply. Finally, cartridges 2 and 3 had a greater volumetric efficiency, and were able to deliver an increased percentage of ink per fixed cartridge housing volume (e.g. 36 $cm^3$ as noted above). Specifically, cartridges 2 and 3 had a volumetric efficiency of 69% and 68%, respectively, while cartridge 1 had volumetric efficiency of 61%.

Based on the foregoing data, foam members having one or more bores therein provide numerous benefits, including increased ink-retaining capacity and printing/volumetric efficiency compared with foam members which lack any bores or comparable structures. For this reason, the present invention represents a significant advance in the art of printing technology.

Having herein described preferred embodiments of the present invention, it is anticipated that suitable modifications may be made thereto by individuals skilled in the art which nonetheless remain within the scope of the present invention. Accordingly, the present invention shall only be construed in connection with the following claims.

The invention that is claimed is:

1. An ink cartridge for use in printing images on a substrate comprising:

a housing comprising a compartment therein, a first side wall portion, and a second side wall portion;

a printhead affixed to said housing and in fluid communication with said compartment, said printhead comprising ink expulsion means operatively attached thereto for expelling ink on demand from said ink cartridge; and an ink absorbing foam member positioned within said compartment and in fluid communication with said printhead, said foam member comprising a plurality of ink retaining cells therein, said foam member further comprising a first side, a second side, and at least one continuous, elongate bore passing through said foam member from said first side to said second side of said foam member, said first side of said foam member comprising a first opening therein and said second side of said foam member comprising a second opening therein, said first opening and said second opening providing access to said bore, said first opening in said foam member being positioned against said first side wall portion of said housing, and said second opening in said foam member being positioned against said second side wall portion of said housing so that said bore is placed between said first side wall portion and said second side wall portion in order to prevent any ink materials within said bore from prematurely leaking outwardly therefrom.

2. The ink cartridge of claim 1 wherein said bore through said foam member is rectangular in cross-section and uniform in cross-sectional size from said first side of said foam member to said second side thereof.

3. The ink cartridge of claim 1 wherein said foam member further comprises a longitudinal axis therethrough and said bore further comprises a longitudinal axis therein, said bore being positioned within said foam member so that said longitudinal axis of said bore is perpendicular to said longitudinal axis of said foam member.

4. The ink cartridge of claim 1 wherein said ink expulsion means comprises a plate member comprising at least one opening therethrough and a plurality of resistors mounted thereon.

5. The ink cartridge of claim 1 wherein said bore through said foam member is circular in cross-section and uniform in cross-sectional size from said first side of said foam member to said second side thereof.

6. An ink cartridge for use in printing images on a substrate comprising:

a housing comprising a compartment therein;

a printhead affixed to said housing and in fluid communication with said compartment, said printhead comprising ink expulsion means operatively attached thereto for expelling ink on demand from said ink cartridge; and an ink absorbing foam member positioned within said compartment and in fluid communication with said printhead, said foam member comprising a plurality of ink retaining cells therein, said foam member further comprising a first side, a second side, and a plurality of continuous elongate individual bores passing through said foam member from said first side to said second side of said foam member.

7. The ink cartridge of claim 6 wherein said plurality of continuous elongate individual bores comprises about 2–9 bores.

8. An ink cartridge for use in printing images on a substrate comprising:

a housing comprising a compartment therein, a first side wall, and a second side wall, said first side wall comprising a first interior surface, and said second side wall comprising a second interior surface;

a printhead affixed to said housing and in fluid communication with said compartment, said printhead comprising ink expulsion means operatively attached thereto for expelling ink on demand from said ink cartridge; and an ink absorbing foam member positioned within said compartment and in fluid communication with said printhead, said foam member comprising:

a plurality of ink retaining cells;

a first side comprising a plurality of first openings therein;

a second side comprising a plurality of second openings therein; and a plurality of continuous elongate individual bores passing through said foam member from said first side to said second side of said foam member, each of said first openings in said first side of said foam member and each of said second openings in said second side of said foam member providing access to one of said bores;

said foam member further comprising a longitudinal axis therethrough and each of said bores further comprising a longitudinal axis therein, each of said bores being positioned within said foam member so that said longitudinal axis of each of said bores is perpendicular to said longitudinal axis of said foam member; and said foam member being larger than said compartment within said housing in an amount sufficient so that placement of said foam member within said compartment causes compression of said foam member, said compression causing said first side of said foam member to be urged against said first interior surface of said first side wall of said housing, said compression further causing said second side of said foam member to be urged against said second interior surface of said second side wall of said housing.

9. The ink cartridge of claim 8 wherein said plurality of continuous elongate individual bores comprises about 2–9 bores.

10. An ink cartridge for use in printing images on a substrate comprising:

a housing comprising a compartment therein, a first side wall, and a second side wall, said first side wall comprising a first interior surface, and said second side wall comprising a second interior surface;

a printhead affixed to said housing and in fluid communication with said compartment, said printhead comprising ink expulsion means operatively attached thereto for expelling ink on demand from said ink cartridge; and an ink absorbing foam member positioned within said compartment and in fluid communication with said printhead, said foam member comprising:

a plurality of ink retaining cells;

a first side comprising at least one first opening therein;

a second side comprising at least one second opening therein; and at least one continuous, elongate bore passing through said foam member from said first side to said second side of said foam member, said first opening in said first side of said foam member and said second opening in said second side of said foam member providing access to said bore, said first opening in said foam member being positioned against said first interior surface of said first side wall of said housing, and said second opening in said foam member being positioned against said second interior surface of said second side wall of said housing so that said bore is placed between said first side wall and said second side wall in order to prevent any ink materials within said bore from prematurely leaking outwardly therefrom;

said foam member further comprising a longitudinal axis therethrough and said bore further comprising a longitudinal axis therein, said bore being positioned within said foam member so that said longitudinal axis of said bore is perpendicular to said longitudinal axis of said foam member; and said foam member being larger than said compartment within said housing in an amount sufficient so that placement of said foam member within said compartment causes compression of said foam member, said compression causing said first side of said foam member to be urged against said first interior surface of said first side wall of said housing, said compression further causing said second side of said foam member to be urged against said second interior surface of said second side wall of said housing.

11. The ink cartridge of claim 10 wherein said bore through said foam member is circular in cross-section and uniform in cross-sectional size from said first side of said foam member to said second side of said foam member.

12. The ink cartridge of claim 10 wherein said bore through said foam member is rectangular in cross-section and uniform in cross-sectional size from said first side of said foam member to said second side of said foam member.

13. The ink cartridge of claim 10 wherein said ink expulsion means comprises a plate member comprising at least one opening therethrough and a plurality of resistors mounted thereon.

14. A method for printing images on a substrate comprising the steps of:

providing an ink cartridge comprising:

a housing comprising a compartment therein;

a printhead affixed to said housing and in fluid communication with said compartment, said printhead comprising ink expulsion means operatively attached thereto for expelling ink on demand from said ink cartridge;

an ink absorbing foam member positioned within said compartment and in fluid communication with said printhead, said foam member comprising a plurality of ink retaining cells therein, said foam member further comprising a first side, a second side, and a plurality of continuous elongate individual bores passing through said foam member from said first side to said second side of said foam member; and a supply of ink retained within said bores in said foam member;

providing a substrate; and activating said ink cartridge in order to withdraw said ink from said bores in said foam member and thereby expel said ink onto said substrate.

15. The method of claim 14 wherein said plurality of continuous elongate individual bores comprises about 2–9 bores.

16. A method for printing images on a substrate comprising the steps of:

providing an ink cartridge comprising:

a housing comprising a compartment therein, a first side wall portion, and a second side wall portion;

a printhead affixed to said housing and in fluid communication with said compartment, said printhead comprising ink expulsion means operatively attached thereto for expelling ink on demand from said ink cartridge;

an ink absorbing foam member positioned within said compartment and in fluid communication with said printhead, said foam member comprising a plurality of ink retaining cells therein, said foam member further comprising a first side, a second side, and at least one continuous, elongate bore passing through said foam member from said first side to said second side of said foam member, said first side of said foam member comprising a first opening therein and said second side of said foam member comprising a second opening therein, said first opening and said second opening providing access to said bore, said first opening in said foam member being positioned against said first side wall portion of said housing, and said second opening in said foam member being positioned against said second side wall portion of said housing so that said bore is placed between said first side wall portion and said second side wall portion in order to prevent any ink materials within said bore from prematurely leaking outwardly therefrom; and a supply of ink retained within said bore in said foam member;

providing a substrate; and activating said ink cartridge in order to withdraw said ink from said bore in said foam member and thereby expel said ink onto said substrate.

17. The method of claim 16 wherein said ink expulsion means of said ink cartridge comprises a plate member comprising at least one opening therethrough and a plurality of resistors mounted thereon.

18. The method of claim 16 wherein said bore through said foam member in said ink cartridge is rectangular in cross-section and uniform in cross-sectional size from said first side of said foam member to said second side of said foam member.

19. The method of claim 16 wherein said foam member in said ink cartridge further comprises a longitudinal axis therethrough and said bore further comprises a longitudinal axis therein, said bore being positioned within said foam member so that said longitudinal axis of said bore is perpendicular to said longitudinal axis of said foam member.

20. The method of claim 16 wherein said bore through said foam member in said ink cartridge is circular in cross-section and uniform in cross-sectional size from said first side of said foam member to said second side of said foam member.

21. A method for printing images on a substrate comprising the steps of:

providing an ink cartridge comprising:

a housing comprising a compartment therein, a first side wall, and a second side wall, said first side wall comprising a first interior surface, and said second side wall comprising a second interior surface;

a printhead affixed to said housing and in fluid communication with said compartment therein, said printhead comprising ink expulsion means operatively attached thereto for expelling ink on demand from said ink cartridge;

an ink absorbing foam member positioned within said compartment and in fluid communication with said printhead, said foam member comprising a plurality of ink retaining cells therein, a first side comprising at least one first opening therein, a second side comprising at least one second opening therein, and at least one continuous, elongate bore passing through said foam member from said first side to said second side of said foam member, said first opening in said first side of said foam member and said second opening in said second side of said foam member providing access to said bore, said first opening in said foam member being positioned against said first interior surface of said first side wall of said housing, and said second opening in said foam member being positioned against said second interior surface of said second side wall of said housing so that said bore is placed between said first side wall and said second side wall in order to prevent any ink materials within said bore from prematurely leaking outwardly therefrom, said foam member further comprising a longitudinal axis therethrough and said bore further comprising a longitudinal axis therein, said bore being positioned within said foam member so that said longitudinal axis of said bore is perpendicular to said longitudinal axis of said foam member, said foam member being larger than said compartment within said housing in an amount sufficient so that placement of said foam member within said compartment causes compression of said foam member, said compression causing said first side of said foam member to be urged against said first interior surface of said first side wall of said housing, said compression further causing said second side of said foam member to be urged against said second interior surface of said second side wall of said housing; and a supply of ink retained within said bore in said foam member;

providing a substrate; and activating said ink cartridge in order to withdraw said ink from said bore in said foam member and thereby expel said ink onto said substrate.

22. The method of claim 21 wherein said ink expulsion means comprises a plate member comprising at least one opening therethrough and a plurality of resistors mounted thereon.

23. The method of claim 21 wherein said bore through said foam member in said ink cartridge is circular in cross-section and uniform in cross-sectional size from said first side of said foam member to said second side of said foam member.

24. The method of claim 21 wherein said bore through said foam member in said ink cartridge is rectangular in cross-section and uniform in cross-sectional size from said first side of said foam member to said second side of said foam member.

25. A method for printing images on a substrate comprising the steps of:

providing an ink cartridge comprising:

a housing comprising a compartment therein, a first side wall, and a second side wall, said first side wall comprising a first interior surface, and said second side wall comprising a second interior surface;

a printhead affixed to said housing and in fluid communication with said compartment therein, said printhead comprising ink expulsion means operatively attached thereto for expelling ink on demand from said ink cartridge;

an ink absorbing foam member positioned within said compartment and in fluid communication with said printhead, said foam member comprising a plurality of ink retaining cells therein, a first side comprising a plurality of first openings therein, a second side comprising a plurality of second openings therein, and a plurality of continuous elongate individual bores passing through said foam member from said first side to said second side of said foam member, each of said first openings in said first side of said foam member and each of said second openings in said second side of said foam member providing access to one of said bores, said foam member further comprising a longitudinal axis therethrough and each of said bores further comprising a longitudinal axis therein, each of said bores being positioned within said foam member so that said longitudinal axis of each of said bores is perpendicular to said longitudinal axis of said foam member, said foam member being larger than said compartment within said housing in an amount sufficient so that placement of said foam member within said compartment causes compression of said foam member, said compression causing said first side of said foam member to be urged against said first interior surface of said first side wall of said housing, said compression further causing said second side of said foam member to be urged against said second interior surface of said second side wall of said housing; and a supply of ink retained within said bores in said foam member;

providing a substrate; and activating said ink cartridge in order to withdraw said ink from said bores in said foam member and thereby expel said ink onto said substrate.

* * * * *